US009257800B2

(12) United States Patent
Huang et al.

(10) Patent No.: US 9,257,800 B2
(45) Date of Patent: Feb. 9, 2016

(54) CABLE CONNECTOR ASSEMBLY WITH A SHORTER SIZE AND METHOD OF ASSEMBLING THE SAME

(71) Applicant: FOXCONN INTERCONNECT TECHNOLOGY LIMITED, Grand Cayman (KY)

(72) Inventors: Shuai-Hui Huang, Kunshan (CN); Ru-Yang Guo, Kunshan (CN); Qing-Man Zhu, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/604,768

(22) Filed: Jan. 26, 2015

(65) Prior Publication Data

US 2015/0214654 A1 Jul. 30, 2015

(30) Foreign Application Priority Data

Jan. 24, 2014 (CN) ..... 2014 1 0032371

(51) Int. Cl.

| | |
|---|---|
| ***H01R 12/00*** | (2006.01) |
| ***H01R 24/28*** | (2011.01) |
| ***H01R 12/61*** | (2011.01) |
| ***H01R 12/59*** | (2011.01) |
| ***H01R 12/53*** | (2011.01) |
| *H01R 13/62* | (2006.01) |
| *H01R 13/717* | (2006.01) |
| *H01R 12/70* | (2011.01) |
| *H01R 13/6581* | (2011.01) |
| *H01R 107/00* | (2006.01) |

(52) U.S. Cl.

CPC ..... *H01R 24/28* (2013.01); *H01R 12/53* (2013.01); *H01R 12/592* (2013.01); *H01R 12/61* (2013.01); *H01R 12/707* (2013.01); *H01R 13/6205* (2013.01); *H01R 13/6581* (2013.01); *H01R 13/7175* (2013.01); *H01R 2107/00* (2013.01)

(58) Field of Classification Search

USPC ..... 439/67, 498

See application file for complete search history.

(56) References Cited

U.S. PATENT DOCUMENTS

| | | | | | |
|---|---|---|---|---|---|
| 4,689,721 | A * | 8/1987 | Damerow | H01R 23/70 | 361/70 |
| 4,711,548 | A * | 12/1987 | Arakawa | G03B 17/00 | 396/542 |
| 5,692,911 | A * | 12/1997 | Webster | G01R 1/0408 | 324/754.11 |
| 5,717,556 | A * | 2/1998 | Yanagida | H05K 1/0278 | 174/254 |
| 6,007,371 | A * | 12/1999 | Hickox | H01R 12/61 | 439/498 |
| 6,061,245 | A * | 5/2000 | Ingraham | H01L 23/467 | 174/254 |

(Continued)

FOREIGN PATENT DOCUMENTS

CN 202197450 4/2012

*Primary Examiner* — Tho D Ta

(74) *Attorney, Agent, or Firm* — Wei Te Chung; Ming Chieh Chang

(57) ABSTRACT

A cable connector assembly for mating with a mating connector, including: a printed circuit board (PCB), a mating member mounded on the PCB, an insulative housing receiving the PCB, and a cable extended from the insulative housing. The PCB includes a first portion made of flexible material, a second portion bent and extended from one side of the first portion, and a third portion bent and extended from another side of the first portion. The mating member is soldered on the first portion. The cable is soldered with the second portion and the third portion.

10 Claims, 8 Drawing Sheets

(56) References Cited

U.S. PATENT DOCUMENTS 6,075,708 A * 6/2000 Nakamura ..... H05K 1/141
361/743
7,014,475 B1 * 3/2006 Mongold ..... H01R 12/79
439/67
7,267,552 B2 * 9/2007 Lin ..... H01R 12/592
174/117 F F
8,535,088 B2 9/2013 Gao et al.
2005/0032398 A1 * 2/2005 Perret ..... H05K 1/147
439/67
2008/0249363 A1 * 10/2008 Nakamura ..... A61B 1/0011
600/132

* cited by examiner

CABLE CONNECTOR ASSEMBLY WITH A SHORTER SIZE AND METHOD OF ASSEMBLING THE SAME

BACKGROUND OF THE INVENTION

1. Field of the Invention

The present invention relates to a cable connector assembly, and more particularly to the structure of the printed circuit board of the cable connector assembly.

2. Description of Related Arts

U.S. Pat. No. 8,535,088, issued on Sep. 17, 2013, discloses a cable plug including housing, cable, assembly, contact portion, contact pins, circuit board, and LEDs. Circuit board may be a printed circuit board, flexible circuit board, or other appropriate circuit board. Circuit board fits around assembly and includes a horizontal flat part and a pair of vertical parts extending downwardly from the sides of the flat part. Contact pins may fit in passages of the assembly. Circuit board is soldered to the contact pins and affixed to the assembly. LEDs are located on the vertical parts of the circuit board. Cable is inserted through the housing. A center conductor and metallic braiding of cable or cable wires are soldered to the contact portion.

An improved cable connector assembly is desired to offer advantages over the related art.

SUMMARY OF THE INVENTION

An object of the present invention is to provide a cable connector assembly of a short length.

To achieve the above-mentioned object, a cable connector assembly for mating with a mating connector includes: a printed circuit board (PCB), a mating member mounded on the PCB, an insulative housing receiving the PCB, and a cable extended from the insulative housing. The PCB includes a first portion made of flexible material, a second portion bent and extended from one side of the first portion, and a third portion bent and extended from another side of the first portion. The mating member is soldered on the first portion. The cable is soldered with the second portion and the third portion.

According to the present invention, the PCB of the cable connector assembly is partly made of flexible material. Parts of the core wires are soldered with the conductive pads of the first surface and the second surface when the PCB is spreading. The other core wires are soldered with the conductive pads after bending the PCB. It is convenient to assemble the cable connector assembly. The PCB is partly vertically arranged in the insulative housing, and the other portion of the PCB is horizontally arranged in the insulative housing. The core wires are concentrated to solder with the PCB so as to reduce a length of the cable connector assembly.

DETAILED DESCRIPTION OF THE PREFERRED EMBODIMENT

Reference will now be made in detail to some preferred embodiments of the present invention.

Figure 1:
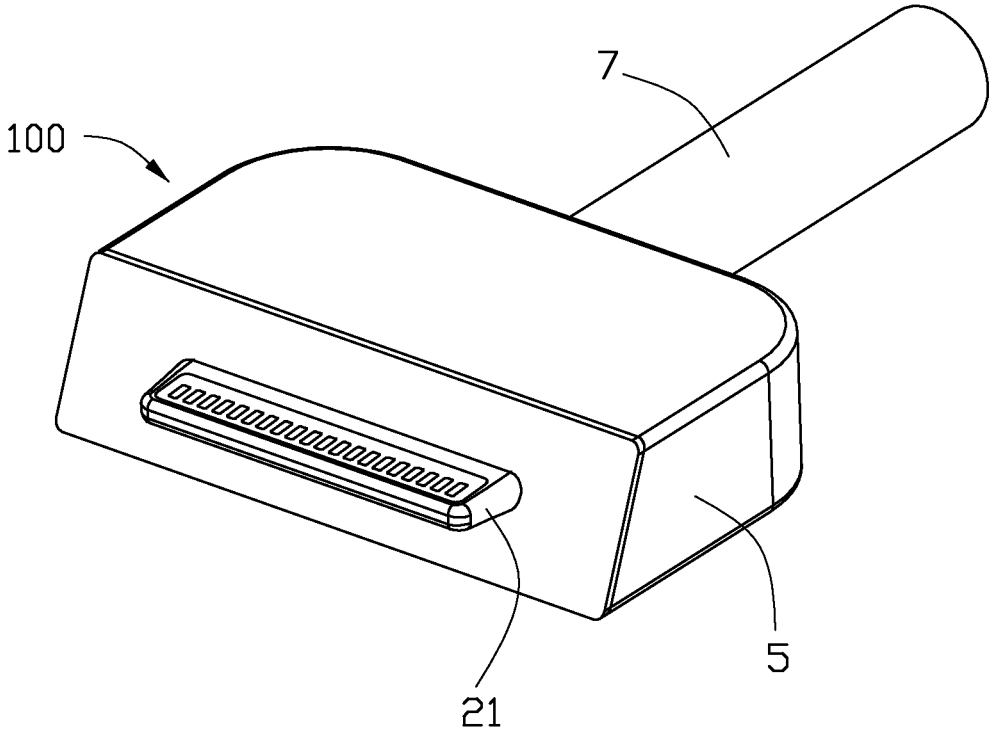
FIG. 1 is a perspective view of a cable connector assembly in accordance with the present invention.
Figure 2:
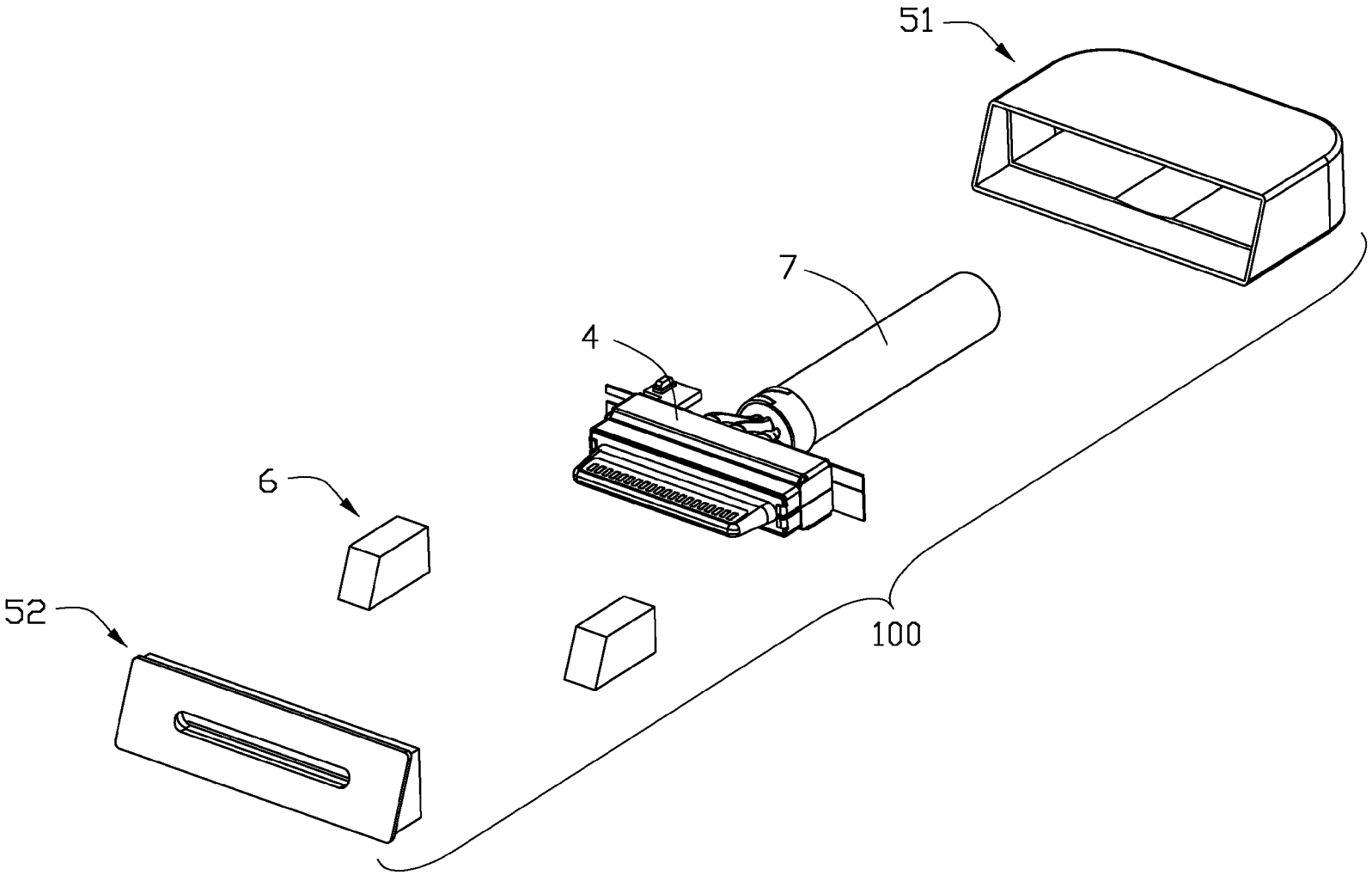
FIG. 2 is a partly exploded view of the cable connector assembly as shown in FIG. 1.
Figure 3:
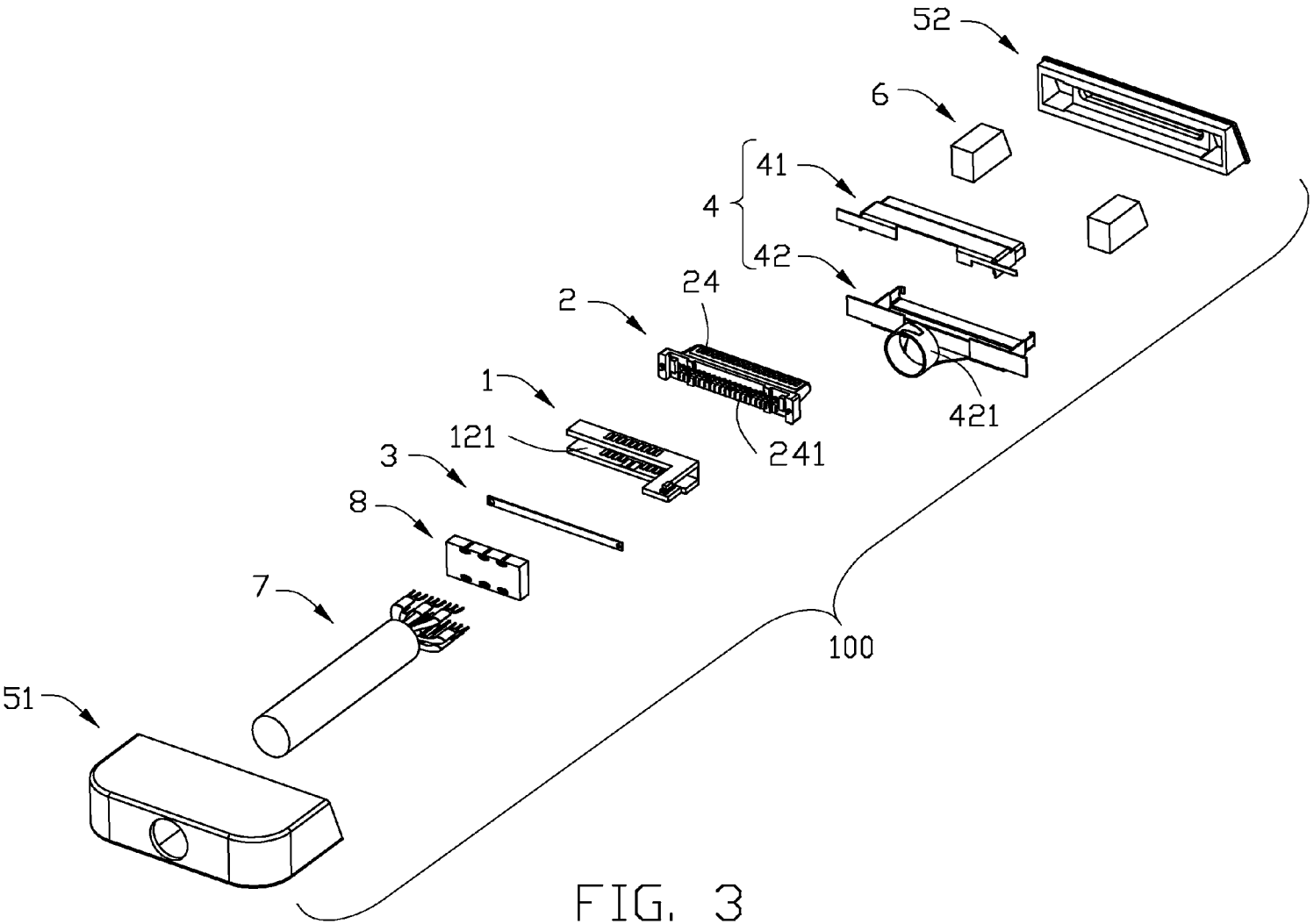
FIG. 3 is an exploded view of the cable connector assembly as shown in FIG. 1.
Figure 4:
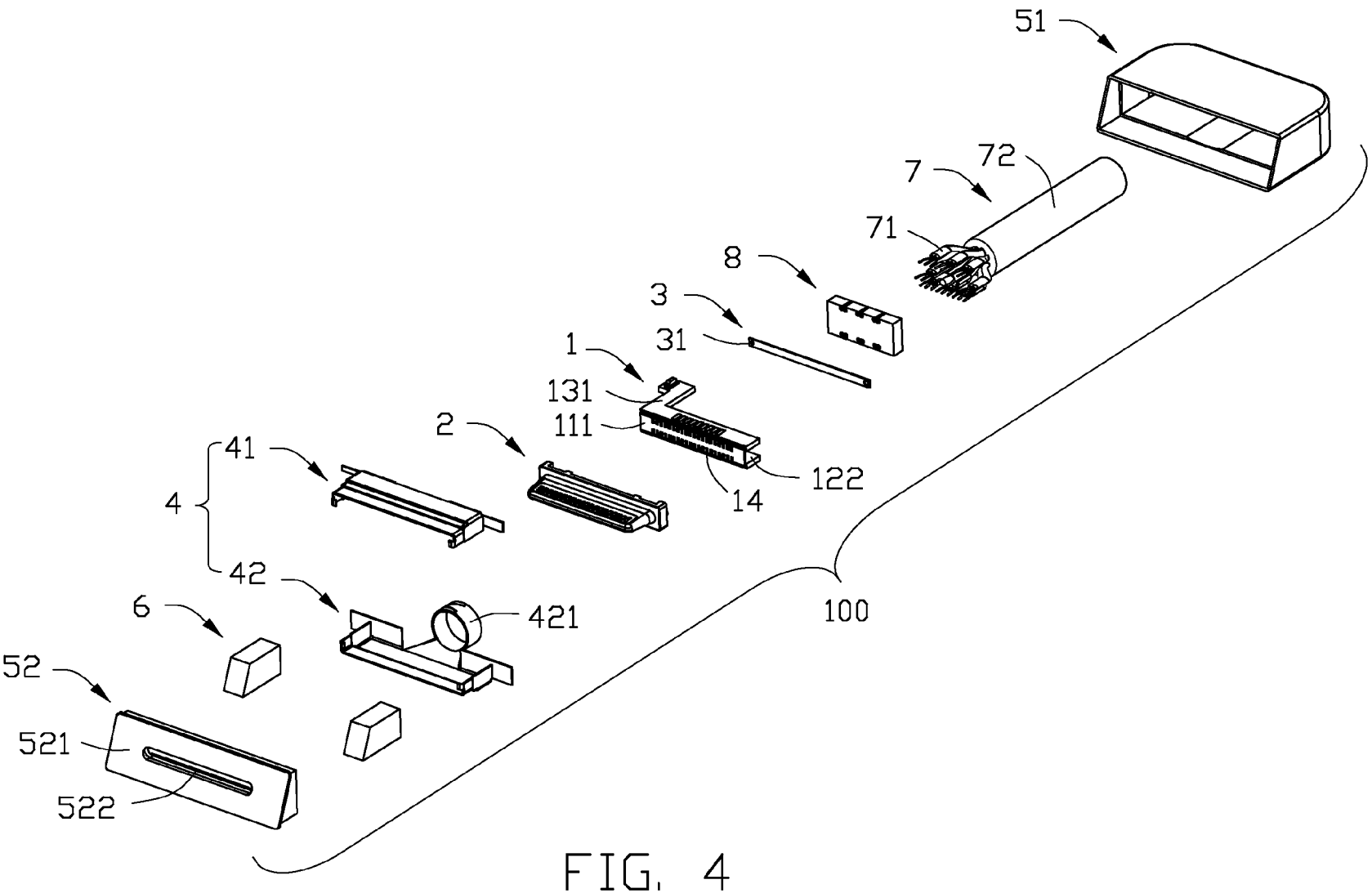
FIG. 4 is another exploded view of the cable connector assembly as shown in FIG. 3.
Figure 5:
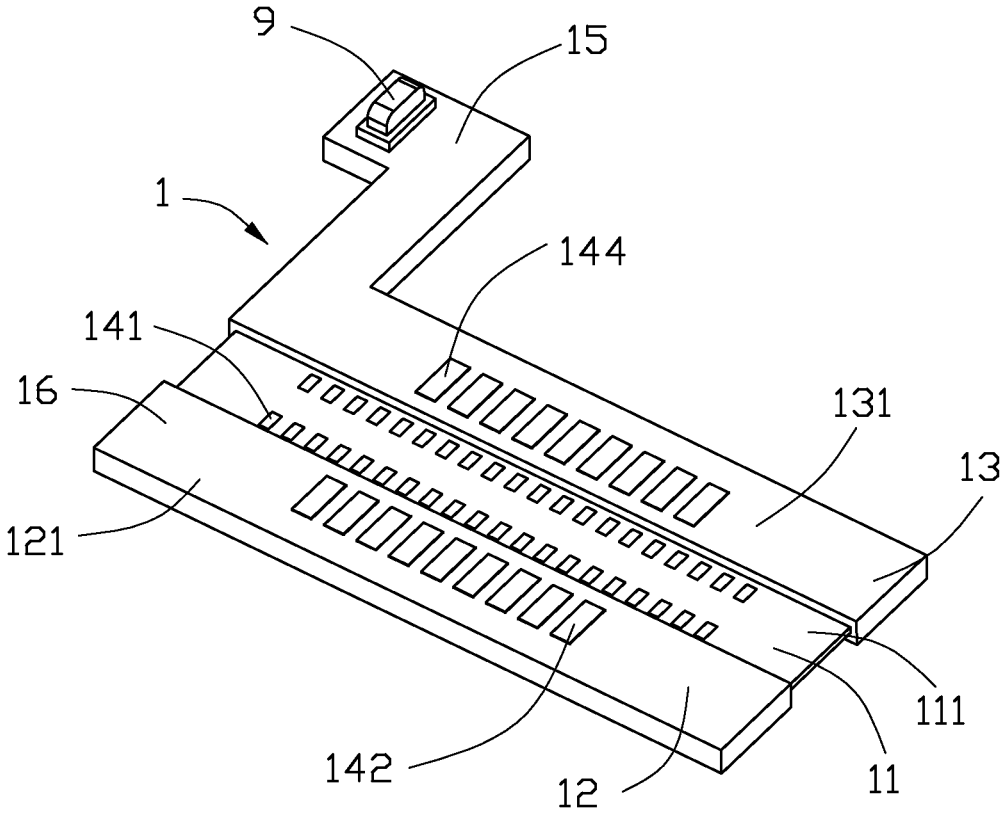
FIG. 5 is a perspective view of the PCB of the cable connector assembly as shown in FIG. 1.
Figure 6:
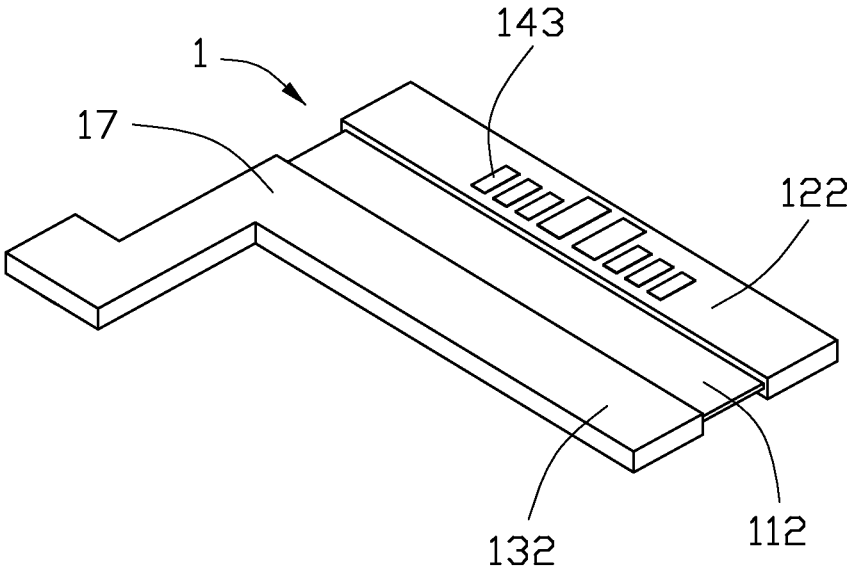
FIG. 6 is another perspective view of the PCB of the cable connector assembly as shown in FIG. 5.
Figure 7:
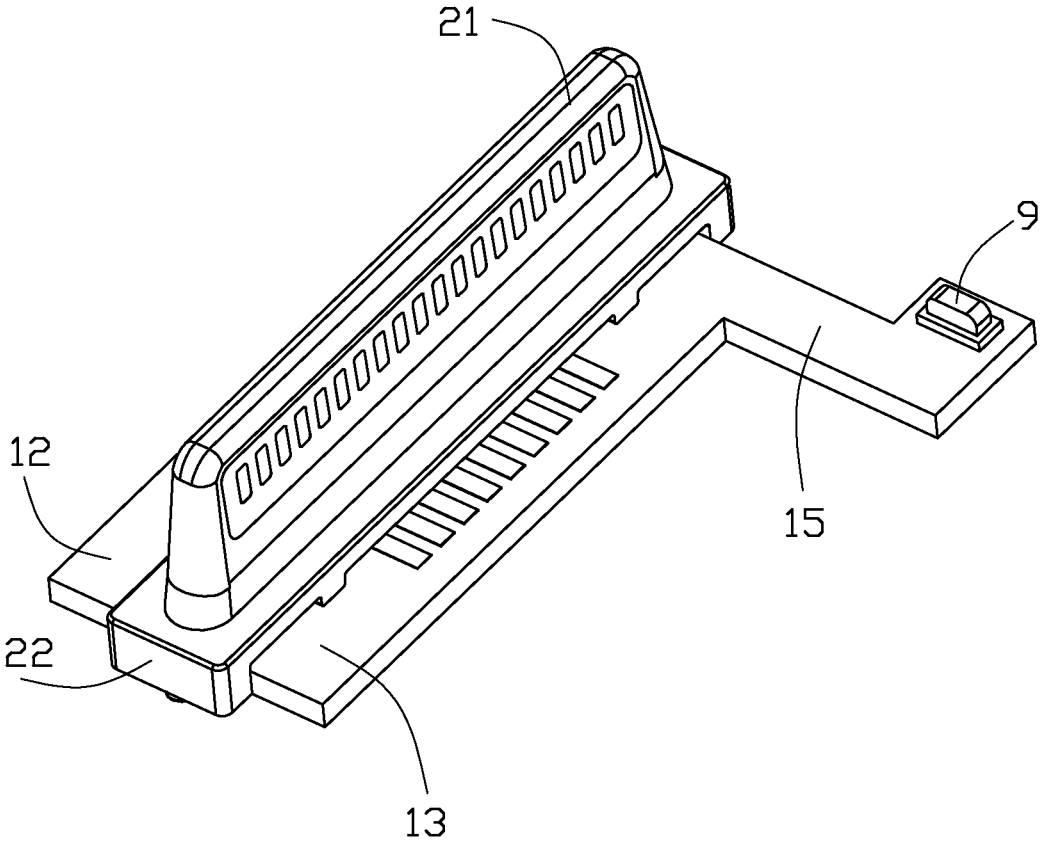
FIG. 7 is a perspective view of the PCB and the mating member of the cable connector assembly as shown in FIG. 1.
Figure 8:
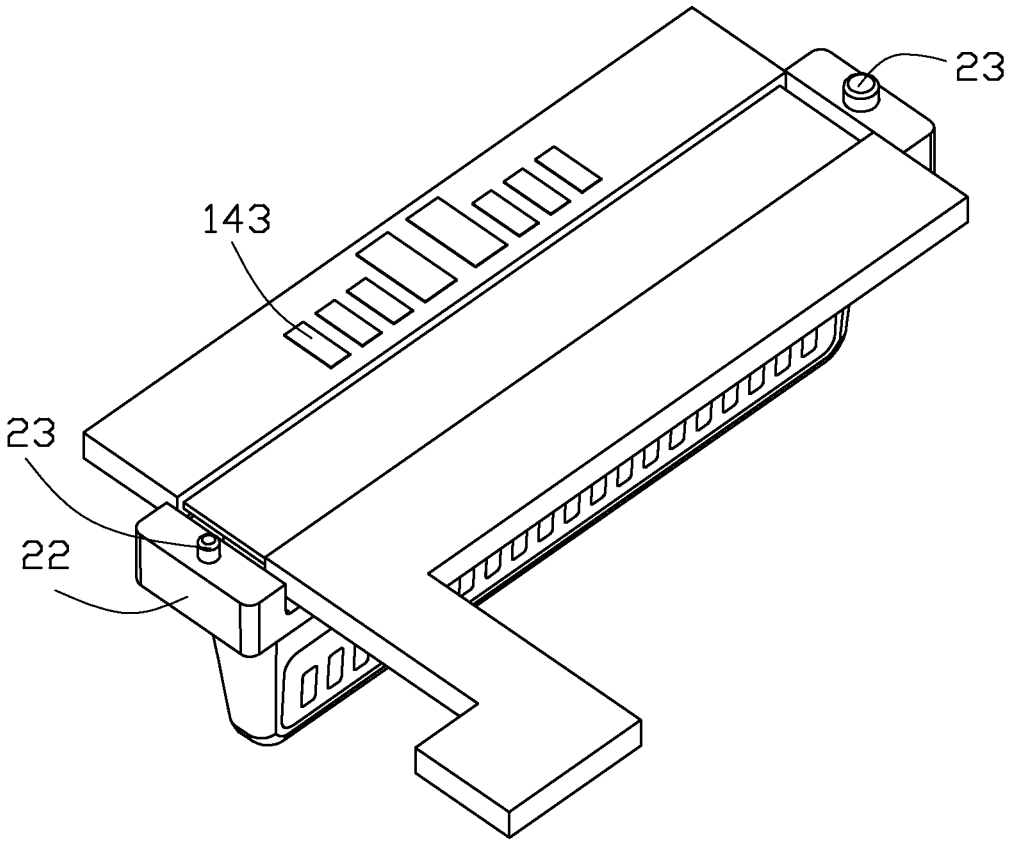
FIG. 8 is another perspective view of the PCB and the mating member of the cable connector assembly as shown in FIG. 7.

FIGS. 1 to 8 show a cable connector assembly 100 in accordance with a preferred embodiment of the present disclosure. Referring to FIGS. 1 to 4, a cable connector assembly 100 for mating with a mating connector (not shown) comprises a printed circuit board (PCB) 1, a mating member 2 mounded on the PCB 1, a stopping board 3 disposed on the PCB 1, a metal shell 4 coating the PCB 1, an insulative housing 5 enclosing the metal shell 4, a magnetic member 6 received in the insulative housing 5, a cable 7 extended from the insulative housing 5, and a line spacer 8 mounted on the cable 7.

Referring to FIGS. 5 to 8, the PCB comprises a first portion 11 made of flexible material, a second portion 12 bent and extended from one side of the first portion 11, and a third portion 13 bent and extended from another side of the first portion 11. The second portion 12 extends opposite to the mating member 2 from one side of the first portion 11, and the third portion 13 extends opposite to the mating member 2 from another side of the first portion 11. The mating member 2 is mounded on the PCB 1 and soldered on the first portion 11. And the cable 7 is soldered with the second portion 12 and the third portion 13. The first portion 11 comprises a first side wall 111 and an opposite second side wall 112. The second portion 12 comprises a third side wall 121 and an opposite fourth side wall 122. The third portion 13 comprises a fifth side wall 131 and an opposite sixth side wall 132. The fourth side wall 122 is disposed opposite to the sixth side wall 132. The mating member 2 is soldered on the first side wall 111 of the first portion 11.

A plurality of conductive pads 14 are disposed on the PCB 1. The conductive pads 14 comprises a plurality of first pads 141 disposed on the first side wall 111 of the first portion 11 and soldered with the mating member 2, a plurality of second pads 142 disposed on the third side wall 121 of the second portion 12, a plurality of third pads 143 disposed on the fourth side wall 122 of the second portion 12, and a plurality of fourth pads 144 disposed on the fifth side wall 131 of the third portion 13. The second pads 142, the third pads 143, and the fourth pads 144 are all soldered with the cable 7. The PCB 1 further comprises a projecting portion 15 protruding horizontally from the third portion 13. A LED 9 is disposed on the projecting portion 15.

The mating member 2 comprises a mating portion 21 for mating with the mating connector and a mounting portion 22 mounted on the PCB 1. A width of the mounting portion 22 is larger than the width of the first portion 11 of the PCB 1. The mating portion 21 comprises a mounting post 23 on a portion extending beyond the first portion 11. The mating member 2 comprises a plurality of terminals 24 fixed in the mating member 2. The terminal 24 extends out of the mounting portion 22 of the mating member 2 to form a soldering portion 241. The soldering portion 214 is attached to the first conductive 141 using surface mount technology (SMT).

The stopping board 3 is mounted on the second side wall 112 of the first portion 11. The stopping board 3 comprises a mounting hole 31 on a position corresponding to the mounting post 23. The mounting post 23 mates with the mounting hole 31 to make the mating member 2 fixed firmly on the PCB 1.

The metal shell 4 comprises an upper shell 41 and a lower shell 42 mating with the upper shell 41. The lower shell 42 comprises a crimping portion 421. A ring will be formed enclosing the cable 7 by bending the crimping portion 421 when assembling the metal shell 4. The crimping portion 421 also can be formed on the upper shell 41.

The insulative housing 5 comprises a main housing 51 and a cover 52 disposed before the main housing 51. The cover 52 comprises a front face 521 defining an opening 522 for extending by the mating portion 21 out of the insulative housing 5. The front face 521 is set inclined for avoiding the cable connector assembly 100 being inserted into the mating connector erroneously.

There are a pair of magnetic members 6. Each side of the mating member 2 has a magnetic members 6 respectively.

The cable 7 comprises a plurality of core wires 71 and an outer layer 72 coating the core wires 71. The core wires 71 are arranged in two rows by the line spacer 8 for being soldered with the conductive pads 14 of the PCB 1.

A method for manufacturing the cable connector assembly 100 comprises the steps as follows.

Provided is a flat PCB 1 defining a first portion 11 made of flexible material, a second portion 12, and a third portion 13 bent and extending from two sides of the first portion 11, respectively. The PCB 1 comprises a first surface 16 and an opposite second surface 17. There are a plurality of first pads 141 disposed on the first surface 16 of the first portion 11, a plurality of second pads 142 disposed on the first surface 16 of the second portion 12, a plurality of third pads 143 disposed on the second surface 17 of the second portion 12, and a plurality of fourth pads 144 disposed on the first surface 16 of the third portion 13.

A mating member 2 is soldered with the first pads 141 on the first surface 16 of the PCB 1. Both sides of the mating portion 22 extend beyond the two sides of the first portion 11 of the PCB 1. A stopping board 3 is mounted on the second surface 17 of the first portion 11. The mounting hole 31 mates with the mounting post 23 of the mounting portion 22 of the mating member 2.

A cable 7 is provided that has a plurality of core wires 71. A line spacer 8 is provided to separate the core wires 71 for soldering with the mating member 2. Parts of the core wires 71 are soldered with the second pads 142 and the third pads 143 on the second portion 12. The PCB 1 is bent to extend the second portion 12 opposite to the mating member 2 and also extend the third portion 13 opposite to the mating member 2 too. The first surface 16 forms the first side wall 111 on the first portion 11, forms the third side wall 121 on the second portion 12, and forms the fifth side wall 131 on the third portion 13 after bending. The second surface 17 forms the second side wall 112 on the first portion 11, forms the fourth side wall 122 on the second portion 12, and forms the sixth side wall 132 on the third portion 13 after bending. At this moment, the fourth side wall 122 is opposite to the sixth side wall 132. Then the remaining core wires 71 are soldered with the fourth pads 144 on the third portion 13.

A metal shell 4 is provided to coat the PCB 1 in an up to down direction. The crimping portion 421 is bent to form a ring to enclose the cable 7. An insulative housing 5 is provided which comprises a main housing 51 and a cover 52. The main housing 51 receives the metal shell 4. A pair of magnetic members 6 are disposed on the two sides of the mating member 2. The cover 52 is mounted and fixed in front of the main housing 51 for extending the mating portion 32 out of the insulative housing 5 from the opening 522.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a mating connector, comprising:

a printed circuit board (PCB) comprising a first portion made of flexible material, a second portion bent and extended from one side of the first portion, and a third portion bent and extended from another side of the first portion;

a mating member soldered to the first portion;

an insulative housing receiving the PCB;

a cable extended from the insulative housing and soldered with the second portion and the third portion; and wherein a plurality of conductive pads are disposed on the PCB, the conductive pads comprising a plurality of first pads disposed on the first side wall of the first portion and soldered with the mating member, a plurality of second pads disposed on the third side wall of the second portion, a plurality of third pads disposed on the fourth side wall of the second portion, and a plurality of fourth pads disposed on the fifth side wall of the third portion, the second pads, the third pads, and the fourth pads all soldered with the cable;

wherein the mating member comprises a mating portion for mating with the mating connector and a mounting portion mounted on the PCB, a width of the mounting portion being larger than the width of the first portion of the PCB;

a stopping board mounted on the second side wall of the first portion; wherein the mating portion comprises a mounting post on a portion thereof extending beyond the first portion, and the stopping board comprises a mounting hole at a position corresponding to the mounting post, the mounting post mating with the mounting hole to retain the mating member firmly on the PCB.

2. The cable connector assembly as recited in claim 1, wherein the first portion comprises a first side wall and an opposite second side wall, the second portion comprising a third side wall and an opposite fourth side wall, the third portion comprising a fifth side wall and an opposite sixth side wall, the fourth side wall disposed opposite to the sixth side wall, the mating member soldered on the first side wall of the first portion, the second portion extending opposite to the mating member from one side of the first portion, the third portion extending opposite to the mating member from another side of the first portion.

3. The cable connector assembly as recited in claim 1, further comprising a light emitting diode (LED), and wherein the PCB comprises a projecting portion protruding horizontally from the third portion to receive the LED.

4. A method for manufacturing a cable connector assembly, comprising the steps of:

providing a printed circuit board (PCB) defining a first portion made of flexible material, a second portion bent and extended from one side of the first portion, and a third portion bent and extended from another side of the first portion, the PCB comprising a first surface and an opposite second surface, a plurality of first pads disposed on the first surface of the first portion, a plurality of second pads disposed on the first surface of the second portion, a plurality of third pads disposed on the second surface of the second portion, and a plurality of fourth pads disposed on the first surface of the third portion;

soldering a mating member with the first pads of the PCB;

providing a cable defining a plurality of core wires and soldering part of the core wires with the second pads and the third pads on the second portion;

bending the PCB to extend the second portion opposite to the mating member and to extend the third portion opposite to the mating member;

soldering the remaining core wires with the fourth pads on the third portion; and mounting the PCB to an insulative housing;

wherein the mating member comprises a mating portion for mating with the mating connector and a mounting portion received in the insulative housing, both sides of the mounting portion extending beyond the first portion of the PCB when soldered with the PCB.

5. The method as recited in claim 4, further comprising a step of mating a stopping board with a mounting post of the mating portion to firmly fixing the mating member on the PCB.

6. An electrical connector comprising:

a printed circuit board having a first portion spanning in a first plane, and a second portion spanning in a second plane angled with regard to the first plane;

a mating member including a plurality of contacts arranged with one another along a transverse direction and mounted upon the first portion along a front-to-back direction perpendicular to said first plane and said transverse direction;

a cable having a plurality of wires extending along the front-to-back direction and arranged with one another along said transverse direction and mechanically and electrically connected to the second portion; and an insulative housing enclosing the printed circuit board and a rear portion of the mating member; wherein the cable extends out of a rear end of the housing;

wherein there are two second portions essentially symmetrically arranged by two sides of the first portion in a vertical direction perpendicular to both said front-to-back direction and transverse direction, except that one of said second portions is further equipped with along the front-to-back direction an extension on which an LED (Laser Emitting Diode) is located.

7. The electrical connector as claimed in claim 6, wherein said printed circuit board is flexible.

8. The electrical connector as claimed in claim 7, wherein said first portion and perpendicular to said second portion.

9. The electrical connector as claimed in claim 7, further including rigid board assembled to the mating member to firmly sandwich the first portion of the printed circuit board therebetween along the front-to-back direction.

10. The electrical connector as claimed in claim 7, wherein a pair of magnetic elements located by two sides of the mating member in said transverse direction.

* * * * *